United States Patent [19]

Mathis

[11] 4,232,466

[45] Nov. 11, 1980

[54] COLLAPSIBLE DISPLAY FRAME

[76] Inventor: Terry S. Mathis, R.R. 2, Box 332A, Galena, Kans. 66739

[21] Appl. No.: 969,290

[22] Filed: Dec. 13, 1978

[51] Int. Cl.[3] ..... G09F 15/00

[52] U.S. Cl. ..... 40/606

[58] Field of Search ..... 40/606, 607, 612; 116/63 P; 340/45

[56] References Cited

U.S. PATENT DOCUMENTS

| | | | |
|---|---|---|---|
| 2,920,768 | 1/1960 | Halip | 40/606 X |
| 3,866,367 | 2/1975 | Strizki | 40/607 |
| 3,868,630 | 2/1975 | Lesondak | 116/63 P |
| 3,971,331 | 7/1976 | Sawyer | 40/606 X |
| 4,104,980 | 8/1978 | Toomey | 116/63 |

*Primary Examiner*—Louis G. Mancene
*Assistant Examiner*—Wenceslao J. Contreras
*Attorney, Agent, or Firm*—Lowe, Kokjer, Kircher, Wharton & Bowman

[57] ABSTRACT

Apparatus for holding a display panel such as a warning sign is the subject of the present invention. The apparatus is particularly designed for use as a barricade in the vicinity of road construction. The apparatus is constructed of standard plastic tubing and fittings of the type used in the plumbing industry. A break-away construction minimizes damage in the event an object strikes the apparatus and makes repair quick and economical. Four tubular leg supports are arranged in two converging pairs and are each presented by tubular members held together by a standard T-coupling. Standard Y-couplings join the two pairs of leg supports at their point of convergence. First and second transverse tubular members extend between the T-couplings on the respective pairs of legs and each of the transverse members is of a length equal to twice the length of the members which form the legs. This permits the two leg sections to be made by simply dividing a transverse segment into half. A third transverse tubular segment extends between the Y-couplings and is joined to the latter by standard elbow fittings. A flexible line extends through at least two of the leg supports and between the supports through the T-couplings. The two ends of this line are joined to tensioning means such as a coil spring that is disposed in the third transverse tubular segment which spans the distance between the Y-couplings. At least two of the leg supports are removable from the Y-couplings so that they may be moved to a position in folded relationship next to the other two leg supports, and held in this position by the line.

4 Claims, 3 Drawing Figures

COLLAPSIBLE DISPLAY FRAME

This invention relates generally to display devices and, more particularly, to an apparatus for holding a display panel which apparatus is designed to collapse upon impact with an object and which is constructed so as to provide a means for partial replacement of a segment with minimal time and expense.

It is of course, common practice to utilize barricades to warn traffic of road hazards, including road construction. Most conventional barricades have been constructed from metal or wood and in some instances from plastic tubing. The metal and wood barricades of the prior art are subject to deterioration from the elements and cannot be practically repaired if they become damaged to any significant extent. Barricades made from plastic tubing are less subject to damage but have not heretofore been constructed to collapse upon impact and have not previously been constructed so that a small segment of the barricade may be replaced in a minimal amount of time if damage occurs.

It is therefore a primary object of the present invention to provide apparatus for holding a display panel which is constructed from standard plastic tubing and plumbing fittings thereby providing a device which is economical to construct and virtually maintenance free;

An important object of the invention is to provide a display apparatus which is sturdy and yet may be folded for transport and storage purposes.

A very important aim of my invention is to provide display apparatus which may be utilized as a barricade or warning device, which is collapsible on impact to minimize damage;

A very important object of the invention is to provide apparatus for use as a protective barricade which is constructed of plastic tubing to minimize the danger to persons who may be struck by the apparatus in the event of an automobile collision;

Another aim of the present invention is to provide apparatus as described in the foregoing objects which is characterized by a retaining line for holding at least some of the components of the apparatus together upon collapse or impact with a vehicle;

It is also one of the objects of the invention to provide a display apparatus which is constructed from a plurality of separable components to facilitate repair and replacement at a minimal cost in parts and labor in the event of damage;

Other objects of the invention will be made clear or become apparent from the following description and claims when read in light of the accompanying drawing, wherein;

Figure 1:
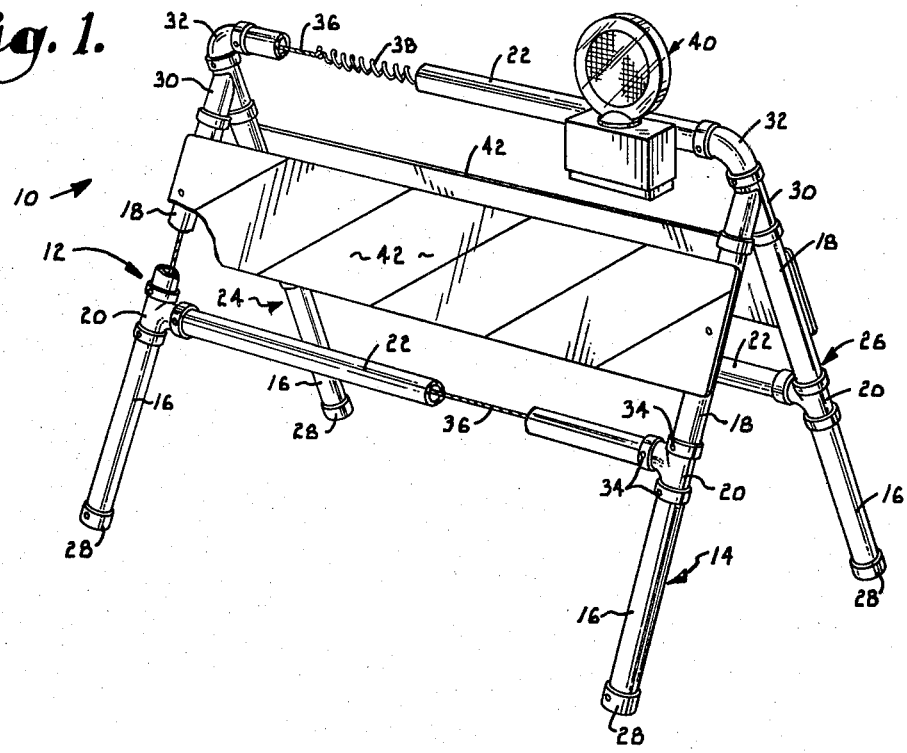
FIG. 1 is a perspective view of the apparatus of the present invention in its operating position with portions broken away for purposes of illustration.

Referring initially to FIG. 1, the apparatus of the invention is designated generally by the numeral 10. Apparatus 10 is comprised of first and second spaced apart leg supports, each designated generally by the numerals 12 and 14 respectively. Each of the leg supports 12 and 14 is comprised of first and second elongated tubular members 16 and 18. All of the tubular members 16 and 18 are equal in length and each set of tubular members 16 and 18 making up one of the leg supports is received by a standard T-coupling 20. A transverse tubular segment 22 extends between first and second leg supports 12 and 14 and is also received by T-couplings 20. Tubular segment 22 is twice the length of segments 16 and 18 for purposes which will be discussed more fully hereinafter.

Third and fourth leg supports 24 and 26 are paired with first and second supports 12 and 14, respectively. Each of the supports 24 and 26 is comprised of tubular members 16 and 18 and a T-coupling 20 the same as supports 12 and 14. A second transverse tubular segment 22 extends between and is received by T-couplings 20 of leg supports 24 and 26. It is to be noted that each of the leg supports 12, 14, 24, and 26 is provided with an end cap 28.

Leg supports 12–24 and 14–26 are disposed in converging relationship and are received by Y-couplings 30. An elbow 32 is received by each coupling 30 and a third transverse tubular segment 22 spans the distance between elbows 32. A plurality of screw fasteners 34 are utilized with couplings 20, 30 and 32 for securing tubular members 16 and 18 as well as transverse segments 22 and elbows 32. It is preferable, however, to omit any screw fasteners between leg supports 12 and 14 and Y-couplings 30.

Extending down through upper tubular members 18 of leg supports 12 and 14 and through transverse tubular segment 22 which extends between leg supports 12 and 14 is a retaining line 36. Line 36 also extends through one leg of each Y-coupling 30 and up through elbows 32. The ends of line 36 are secured to a coil tensioning spring 38 which is disposed within the third and uppermost transverse tubular segment 22. It is to be understood that a second line 36 may extend through the other leg of each Y 30, and down through tubular members 18 of legs 24 and 26. In most constructions, however, this additional line is not required.

A warning flasher light 40 is removably secured to third tubular segment 22 at the top of the device 10. First and second display panels 42 are secured to leg supports 12–14 and 24–26 by screws 34. In the embodiment illustrated in the drawing, the display panel is provided with a reflective striping in a contrasting pattern to warn of a hazard. It is, however, to be understood that other display panels may be utilized on the apparatus including panels which carry advertising and informational messages.

Figure 3:
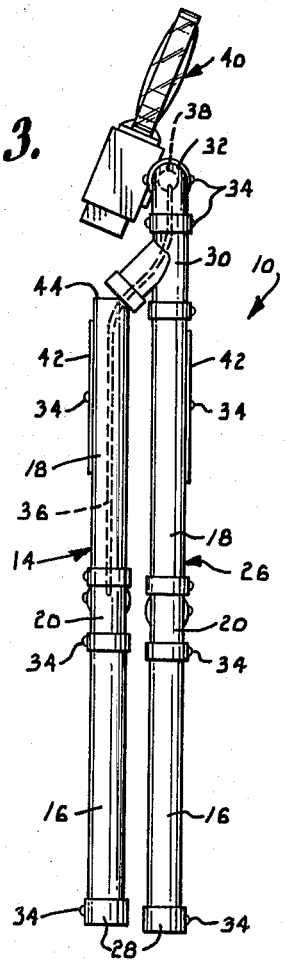
FIG. 3 is an elevational view similar to FIG. 2 and illustrating the apparatus in its folded or collapsed position, which is utilized for storage and transport.

Referring to FIG. 3 of the drawing, apparatus 10 is normally stored and transported in its collapsed or folded position as illustrated. This position is obtained by simply pulling leg supports 12 and 14 out of their respective legs of Y-couplings 30 and moving the leg supports into parallel side-by-side relationship with leg supports 24 and 26. When the apparatus 10 is at the desired location, it is possible to add weight to the apparatus by filling first and second leg supports 12 and 14 with sand or other fine granular material. This is done by use of a funnel placed in the open tops 44 of the two leg supports. It will also be appreciated that line 36 and spring 38 serve to hold apparatus 10 in the collapsed folded position illustrated in FIG. 3, because of the tension applied through the spring.

Figure 2:
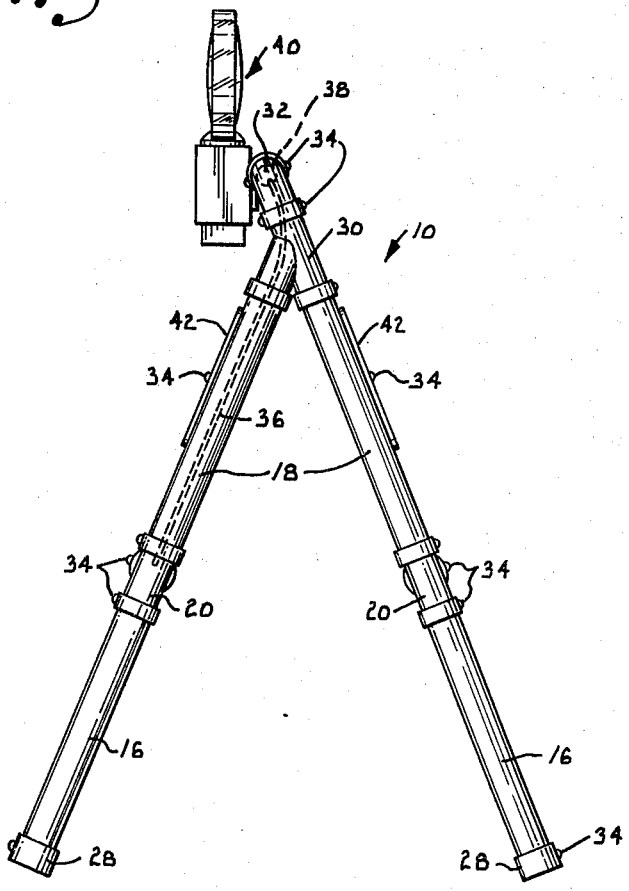
FIG. 2 is a side elevational view of the apparatus shown in FIG. 1.

When the apparatus is to be set up for use, ends 44 of leg supports 12 and 14 are inserted into Y-couplings 30 in the manner shown in FIGS. 1 and 2. If the apparatus is struck by a moving vehicle, the friction fit between couplings 30 and front leg supports 12 and 14 will tend to break away to collapse the device on impact and reduce damage. The presence of line 36 and tensioning device 30 will hold apparatus 10 in its open position, but also serves to retain the various components in the event the apparatus is struck by a moving vehicle. This results in many of the components being recoverable and reusable even though some components may be damaged.

In the preferred embodiment of the invention all of the aforedescribed components are constructed of either standard plastic pipe or standard plastic plumbing fittings. This results in the components being readily available from a variety of sources and also reduces their cost. If one or more components is damaged or destroyed it may easily and quickly be replaced without the need to replace the entire apparatus. By virtue of the fact that each of the transverse tubular segments 22 is of a length twice the length of support members 16 and 18 it is necessary to maintain an inventory only of the tubular segments and these may be cut in half to supply replacement parts for members 16 and 18.

The apparatus of the present invention is virtually weather proof and not subject to deterioration if it is constructed from the preferred material plastic tubing. In addition, the collapsible nature of the device reduces the opportunity for damage in the event of the device being struck, but if damage occurs the multiple component nature of the apparatus makes replacement of a given component relatively easy and inexpensive.

I claim:

1. Apparatus for holding a display panel comprising:

first and second spaced apart leg supports, each of said supports comprising first and second tubular members and a T-coupling joining said members;

third and fourth spaced apart leg supports;

first and second Y-couplings for coupling said first leg support with said third leg support and said second leg support with said fourth leg support;

a line extending through said first and second leg supports and having a segment passing through said member couplings and between said first and second leg supports; and tensioning means coupled with the ends of said line for holding said line under tension, said first and second leg supports being removable from said Y-couplings whereby they may be positioned in folded relationship next to said third and fourth leg supports and held in said folded position by said line.

2. Apparatus as set forth in claim 1, wherein is included a first transverse tubular segment extending between said first and second leg supports and coupled with said T-couplings and a second transverse tubular segment extending between and coupled with said Y-couplings.

3. Apparatus as set forth in claim 2, wherein each of said third and fourth leg supports comprises first and second tubular members and a T-coupling joining said members, and further including a third transverse tubular segment extending between said third and fourth leg supports at said T-couplings.

4. Apparatus as set forth in claim 1, wherein is included a display panel extending transversely of and supported by said first and second leg supports.

* * * * *